US012434927B2

(12) United States Patent
Kitagawa et al.

(10) Patent No.: US 12,434,927 B2
(45) Date of Patent: Oct. 7, 2025

(54) CASSETTE AND PRINTING APPARATUS

(71) Applicant: CANON KABUSHIKI KAISHA, Tokyo (JP)

(72) Inventors: Yosuke Kitagawa, Kanagawa (JP); Hideaki Nagahara, Kanagawa (JP); Tetsuji Kurata, Kanagawa (JP); Yasushi Ishida, Tokyo (JP); Toshiya Matsumoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 17/862,314

(22) Filed: Jul. 11, 2022

(65) Prior Publication Data

US 2023/0057624 A1 Feb. 23, 2023

(30) Foreign Application Priority Data

Aug. 19, 2021 (JP) ..... 2021-134275
Jun. 2, 2022 (JP) ..... 2022-090385

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2405/112* (2013.01); *B65H 2405/115* (2013.01); *B65H 2405/12* (2013.01); *B65H 2551/21* (2013.01); *B65H 2801/03* (2013.01)

(58) Field of Classification Search
CPC .... B65H 1/266; B65H 1/04; B65H 2405/112; B65H 2405/115; B65H 2405/12; B65H 2551/21; B65H 2801/03
See application file for complete search history.

(56) References Cited

U.S. PATENT DOCUMENTS 6,409,165 B1 * 6/2002 Yamaoka ..... B65H 1/12 271/145
7,484,727 B2 * 2/2009 Yang ..... B65H 1/266 271/171
10,958,806 B2 3/2021 Ishihara et al. ..... H04N 1/10
11,345,172 B2 5/2022 Saito et al. ..... B41J 13/10
2004/0169327 A1 * 9/2004 Swayze ..... B41J 13/103 271/145

(Continued)

FOREIGN PATENT DOCUMENTS

JP 3-8633 * 1/1991
JP 5-319588 * 12/1993

(Continued)

OTHER PUBLICATIONS

Machine translation of JP3-8633. (Year: 1991).*
U.S. Appl. No. 17/870,665, filed Jul. 21, 2022.

*Primary Examiner* — Thomas A Morrison
(74) *Attorney, Agent, or Firm* — Venable LLP

(57) ABSTRACT

A cassette comprises a housing portion configured to have a placement face on which sheets are placed and to house sheets; and a standing wall configured to constitute a portion of the housing portion, and to regulate sheets on a back end side in a conveyance direction of sheets to be conveyed from the placement face to a printing apparatus, wherein the standing wall includes a protrusion that protrudes toward the placement face at a position above a predetermined position, which is at a height of sheets that can be stacked on the placement face.

13 Claims, 13 Drawing Sheets

(56) References Cited

U.S. PATENT DOCUMENTS

| | | | | |
|---|---|---|---|---|
| 2009/0041525 | A1 | 2/2009 | Kunioka | 400/207 |
| 2012/0261880 | A1* | 10/2012 | Kozaki | B65H 1/04<br>271/264 |

FOREIGN PATENT DOCUMENTS

| | | | |
|---|---|---|---|
| JP | H05-319588 | | 12/1993 |
| JP | 2004-216661 | | 8/2004 |
| JP | 4829188 | B2 | 12/2011 |
| JP | 6642051 | B2 | 2/2020 |
| WO | WO2011106292 | * | 9/2011 |

* cited by examiner

VICINITY OF CLAWS BACK SIDE
(LEFT INSERTION DIRECTION)

VICINITY OF CLAWS NEAR SIDE
(LEFT INSERTION DIRECTION)

VICINITY OF CLAWS BACK SIDE
(RIGHT INSERTION DIRECTION)

VICINITY OF CLAWS NEAR SIDE
(RIGHT INSERTION DIRECTION)

ENLARGED VIEW OF VICINITY OF CLAWS BACK SIDE
(INSERTION DIRECTION)

ENLARGED VIEW OF VICINITY OF CLAWS NEAR SIDE
(INSERTION DIRECTION)

ENLARGED VIEW OF CLAWS BACK SIDE
(INSERTION DIRECTION)

CASSETTE AND PRINTING APPARATUS

BACKGROUND OF THE INVENTION

Field of the Invention

The present invention relates to a cassette to be used in a printing apparatus such as a printer.

Description of the Related Art

An image forming apparatus such as a printer is provided with a sheet feed cassette for stacking unprinted sheets.

For example, in a technique disclosed in Japanese Patent No. 6642051, a cassette cover that can be attached and detached is arranged on side walls of a sheet feed cassette, the cassette cover can pivot upward, and the sheet feed cassette includes a gripping portion having a sufficient rigidness.

However, in a sheet feed cassette disclosed in Japanese Patent No. 6642051, the sheet feed cassette protrudes from an image forming apparatus body, in an attaching and detaching direction thereof, depending on the sheet size, and therefore a design issue arises. In order to minimize the size of the sheet feed cassette in the attaching and detaching direction, it is desirable that a face of the sheet feed cassette opposite to a face that is inserted into an apparatus body (an opposite face in the insertion direction) is configured by one standing wall. However, when the opposite face is configured by one standing wall, it is difficult to secure a gripping portion of the sheet feed cassette, and secure the rigidness of the gripping portion when gripped.

SUMMARY OF THE INVENTION

The present invention has been made in view of the problems described above, and provides a technique for improving the operability by securing the rigidness of a cassette.

According to a first aspect of the present invention, there is provided a cassette comprising: a housing portion configured to have a placement face on which sheets are placed and to house sheets; and a standing wall configured to constitute a portion of the housing portion, and to regulate sheets on a back end side in a conveyance direction of sheets to be conveyed from the placement face to a printing apparatus, wherein the standing wall includes a protrusion that protrudes toward the placement face at a position above a predetermined position, which is at a height of sheets that can be stacked on the placement face.

According to a second aspect of the present invention, there is provided a printing apparatus to which the cassette described above.

Further features of the present invention will become apparent from the following description of exemplary embodiments with reference to the attached drawings.

DESCRIPTION OF THE EMBODIMENTS

Figure 1:
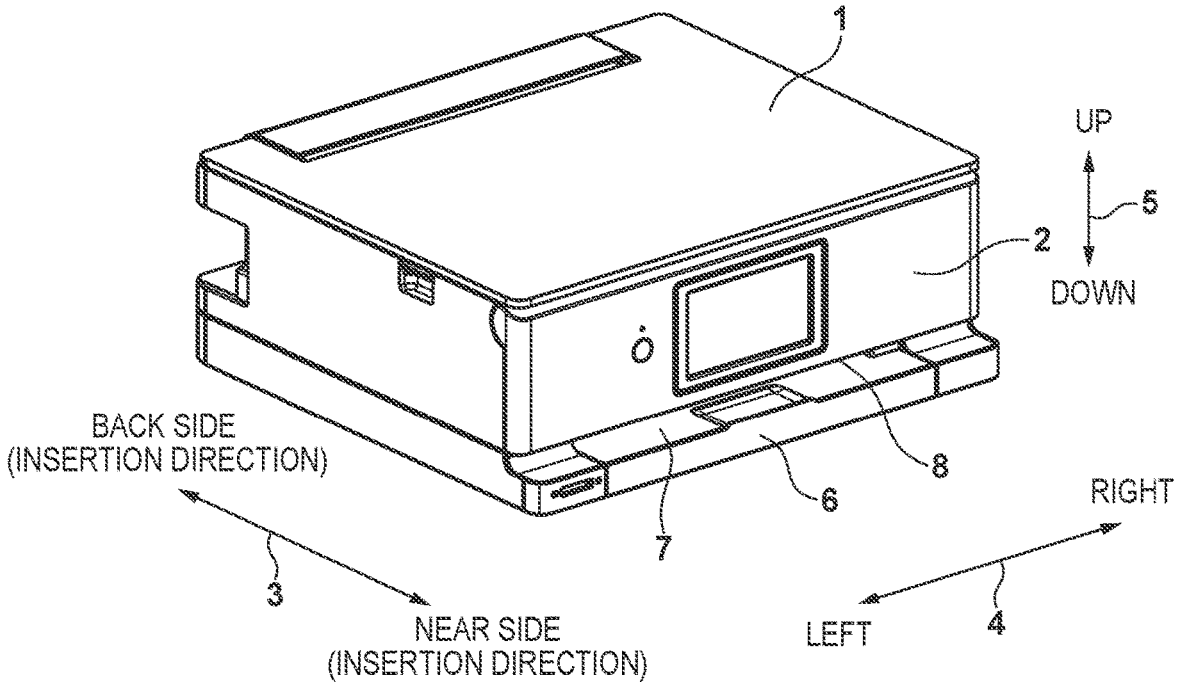
FIG. 1 is an exterior perspective view of an image forming apparatus according to a first embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Note that, although a case where the sheets on which printing is performed are paper will be described in the following embodiments, the sheets may also be made of a material other than paper, and need only be sheet type printing media on which printing can be performed.

First Embodiment

FIG. 1 is an exterior perspective view of an image forming apparatus (printing apparatus) 1 according to a first embodiment of the present invention.

In FIG. 1, the image forming apparatus 1 has a document print function, a document scan function, and the like, and sheets are housed on a placement face of a sheet housing portion, which is inside of a sheet feed cassette 6. A console panel 2 is arranged on a front face side of the apparatus, and a user can operate the image forming apparatus 1 in front of the console panel 2.

The sheet feed cassette 6 can be attached to the image forming apparatus 1, and is inserted in a depth direction through an opening portion 8 for inserting the sheet feed cassette that is formed in the image forming apparatus 1, which will be described later. Here, the directions are defined. The insertion and removal direction of the sheet feed cassette of the image forming apparatus 1 matches a front-and-back direction of the apparatus, and the direction oriented toward back is defined as a back side in the insertion direction, as shown by an arrow 3, and the opposite direction thereof is defined as a near side in the insertion direction. Also, left and right of the image forming apparatus 1 are defined as shown by an arrow 4. Also, upward and downward of the image forming apparatus are defined as shown by an arrow 5.

The configuration of this diagram will be described in more detail. A cassette cover 7 is attached above the sheet feed cassette 6 and prevents sheets from being exposed.

When printing is executed, the console panel 2 is opened automatically or manually, and a print operation is executed.

Figure 2:
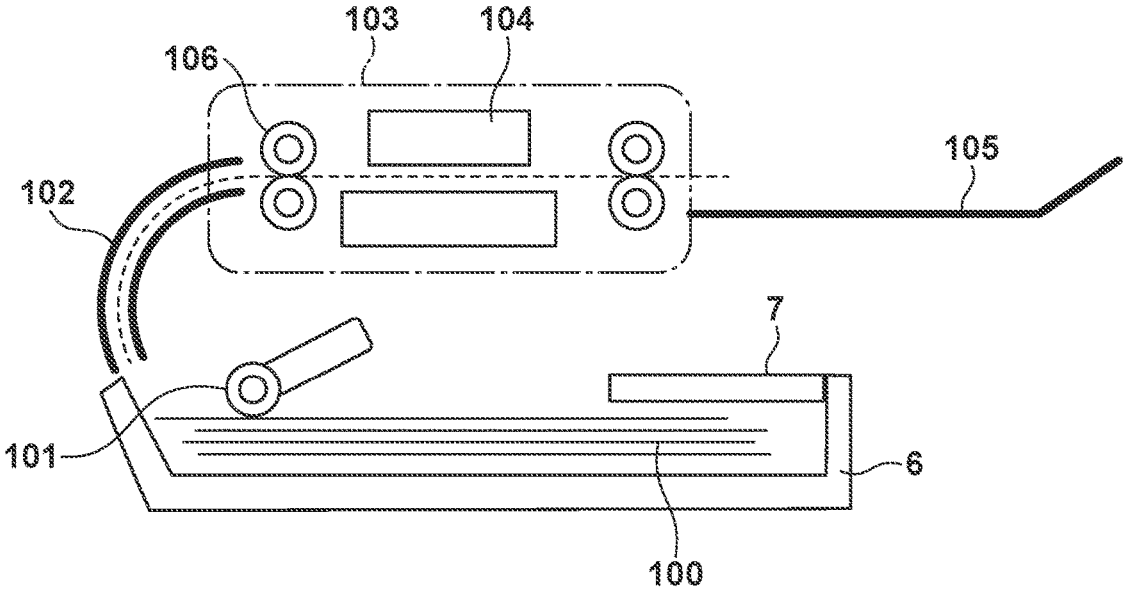
FIG. 2 is a cross-sectional view schematically illustrating the inside of the image forming apparatus.

FIG. 2 is a cross-sectional view schematically illustrating the inside of the image forming apparatus 1, and shows a state in which main devices for performing printing are arranged. The print function will be described using this diagram.

Sheets 100 that are stacked and housed inside the sheet feed cassette are fed out one by one by a sheet feed roller 101 in response to an instruction to start printing, and are conveyed to a printing portion 103 through a guide portion 102. In the printing portion 103, a printing head 104 discharges ink while horizontally and reciprocally moving inside the image forming apparatus 1, and as a result, an image is printed on a sheet that is conveyed by a conveyance roller 106. The sheet on which an image is printed is discharged to a sheet discharge tray 105. The sheet discharge tray 105 is arranged behind the console panel 2 in FIG. 1, and the sheet discharge tray 105 is automatically or manually drawn out forward at the time of printing.

Figure 3:
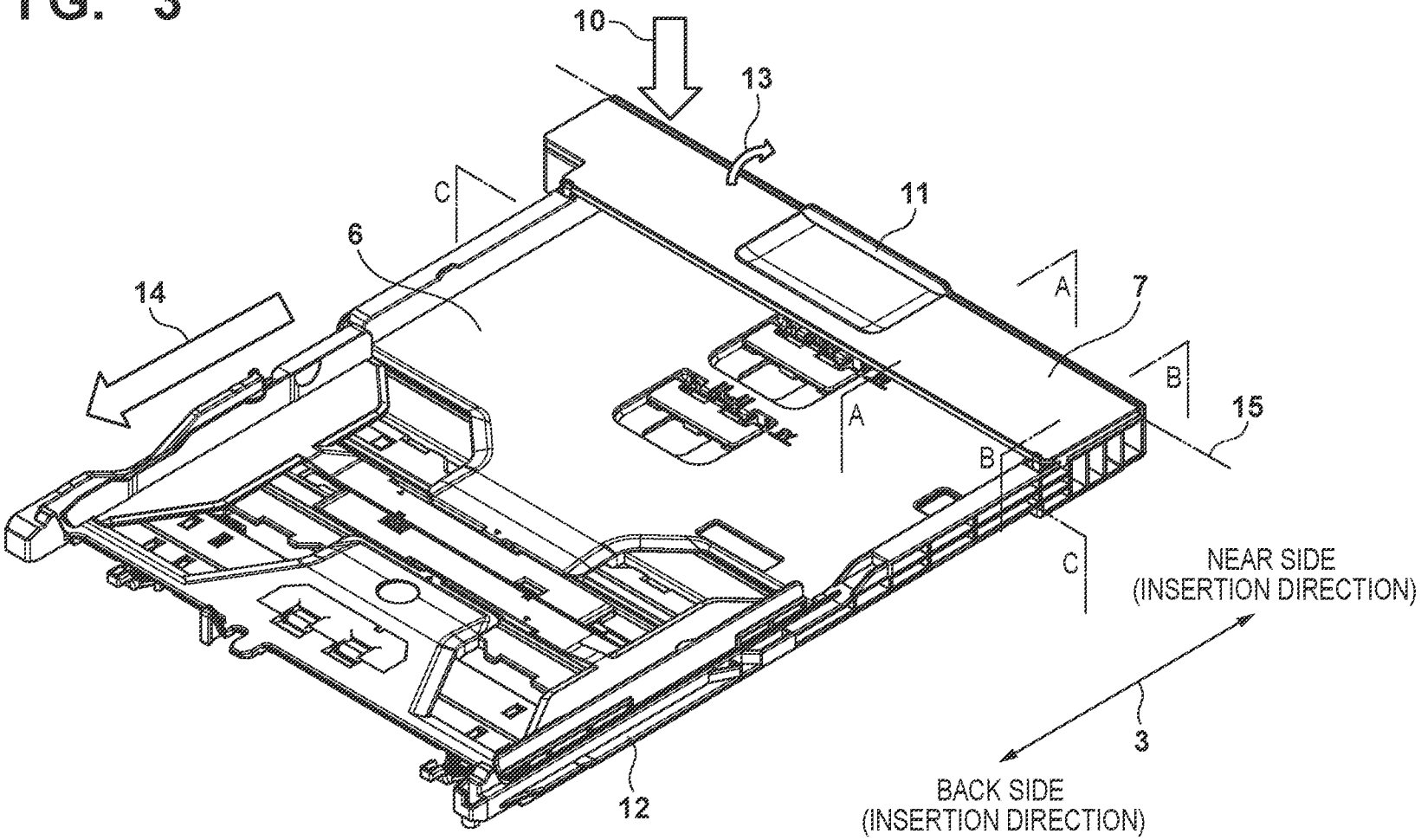
FIG. 3 is a perspective view of a sheet feed cassette in a state in which a cassette cover is attached.

FIG. 3 is a perspective view of the sheet feed cassette in a state in which the cassette cover is attached. The cassette cover 7 can be attached to the sheet feed cassette (cassette main body) 6 in a direction shown by an arrow 10. A later-described gripping portion (standing wall upper portion) 11 is provided in the sheet feed cassette 6 on the near side in the insertion direction thereof, and later-described rails 12, and the like, for attaching the sheet feed cassette 6 to the image forming apparatus 1 are arranged on left and right side faces. Note that the console panel 2 is located on a placement face 41 side relative to a standing wall 28, when the sheet feed cassette 6 is attached to the image forming apparatus 1 (refer to later-described FIGS. 5A and 5B). Therefore, the gripping portion 11 and at least a portion of the cassette cover 7 are exposed outside the image forming apparatus 1.

Figure 4A:
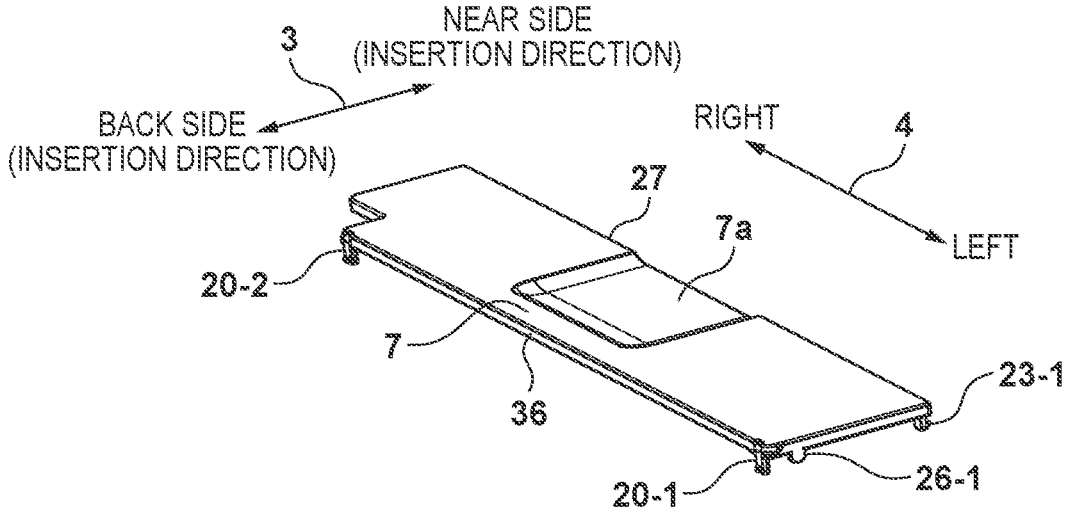
FIGS. 4A to 4F are diagrams illustrating a cassette cover in the first embodiment.
Figure 4B:
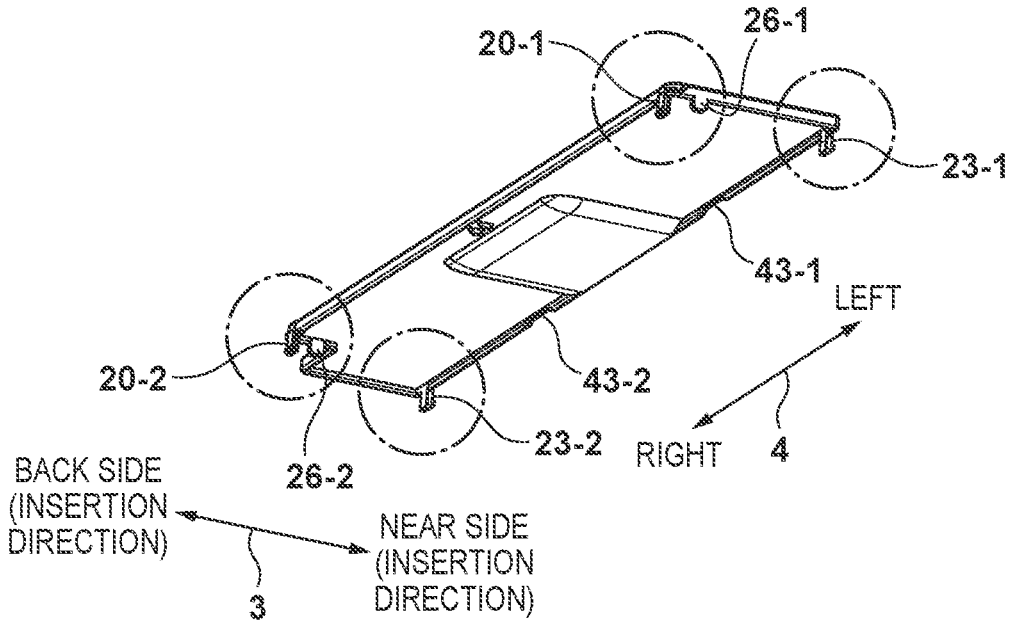
Figure 4C:
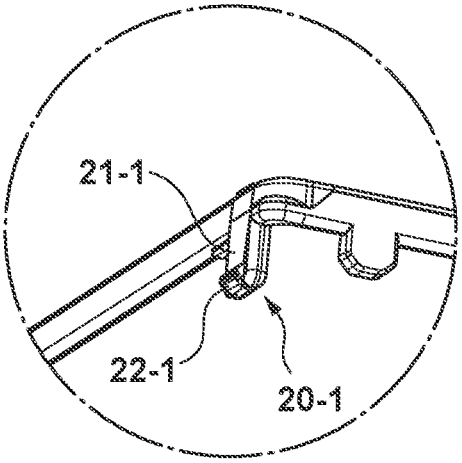
Figure 4D:
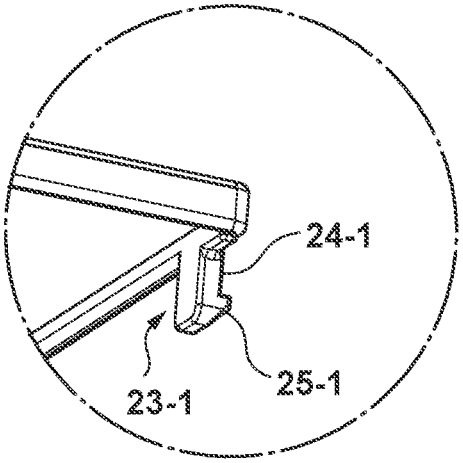
Figure 4E:
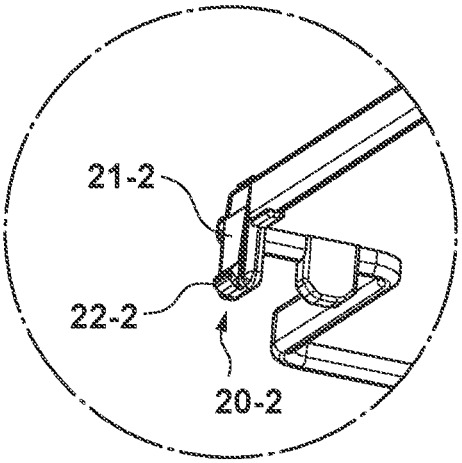
Figure 4F:
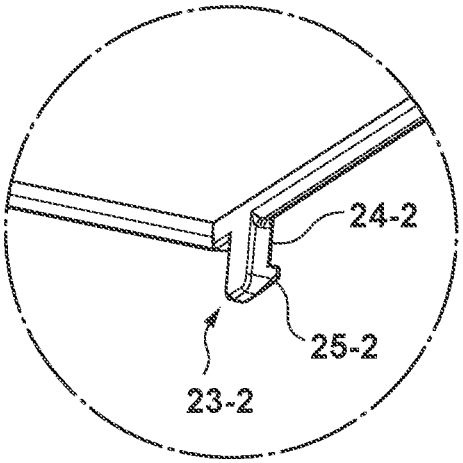

FIGS. 4A to 4F are perspective views of the cassette cover. FIG. 4A is a perspective view of the entire upper face, and FIG. 4B is a perspective view of the entire lower face. Also, FIGS. 4C to 4F are respectively enlarged views in the vicinities of left and right claws on the back side in the insertion direction and on the near side in the insertion direction. A branch number 1 of reference numerals indicates the left side, and a branch number 2 of reference numerals indicates the right side.

In the present embodiment, back side claw installation faces 21 respectively formed in back side projections 20 provided on the left and right sides are oriented in the same direction as the insertion direction of the sheet feed cassette 6, and a back side claw 22 is provided on each of the faces. Also, near side claw installation faces 24 in near side projections 23 are oriented in a direction opposite to the insertion direction of the sheet feed cassette 6, and a near side claw 25 is provided on each of the faces. Furthermore, positioning projections 26 for regulating the positional relationship between the sheet feed cassette 6 and the cassette cover 7 are respectively provided in the cassette cover 7 on the left and right sides. Also, a rib is formed in a horizontal direction in an end portion of the cassette cover 7 on the near side in the insertion direction, and contact parts 43 for contact with later-described hoods 31 (refer to FIG. 5) are formed so as to be cut out of this rib. Note that a recess 7*a* to be gripped by a user, along with the gripping portion 11 of the sheet feed cassette 6, is formed at a position between the left and right contact parts 43 of the cassette cover 7.

Figure 5A:
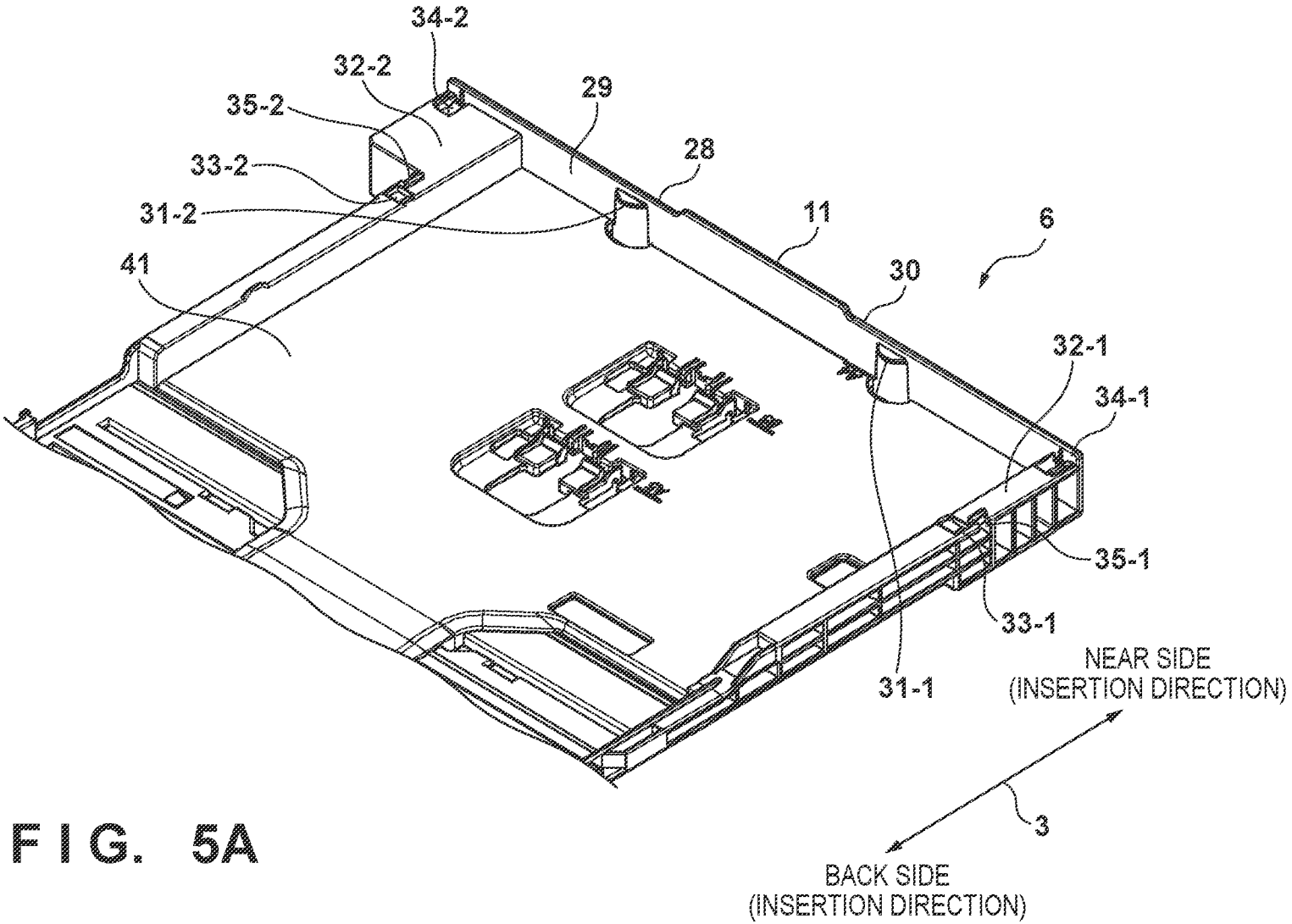
FIGS. 5A and 5B are partial perspective views of a sheet feed cassette in the first embodiment, on a near side in the insertion direction.
Figure 5B:
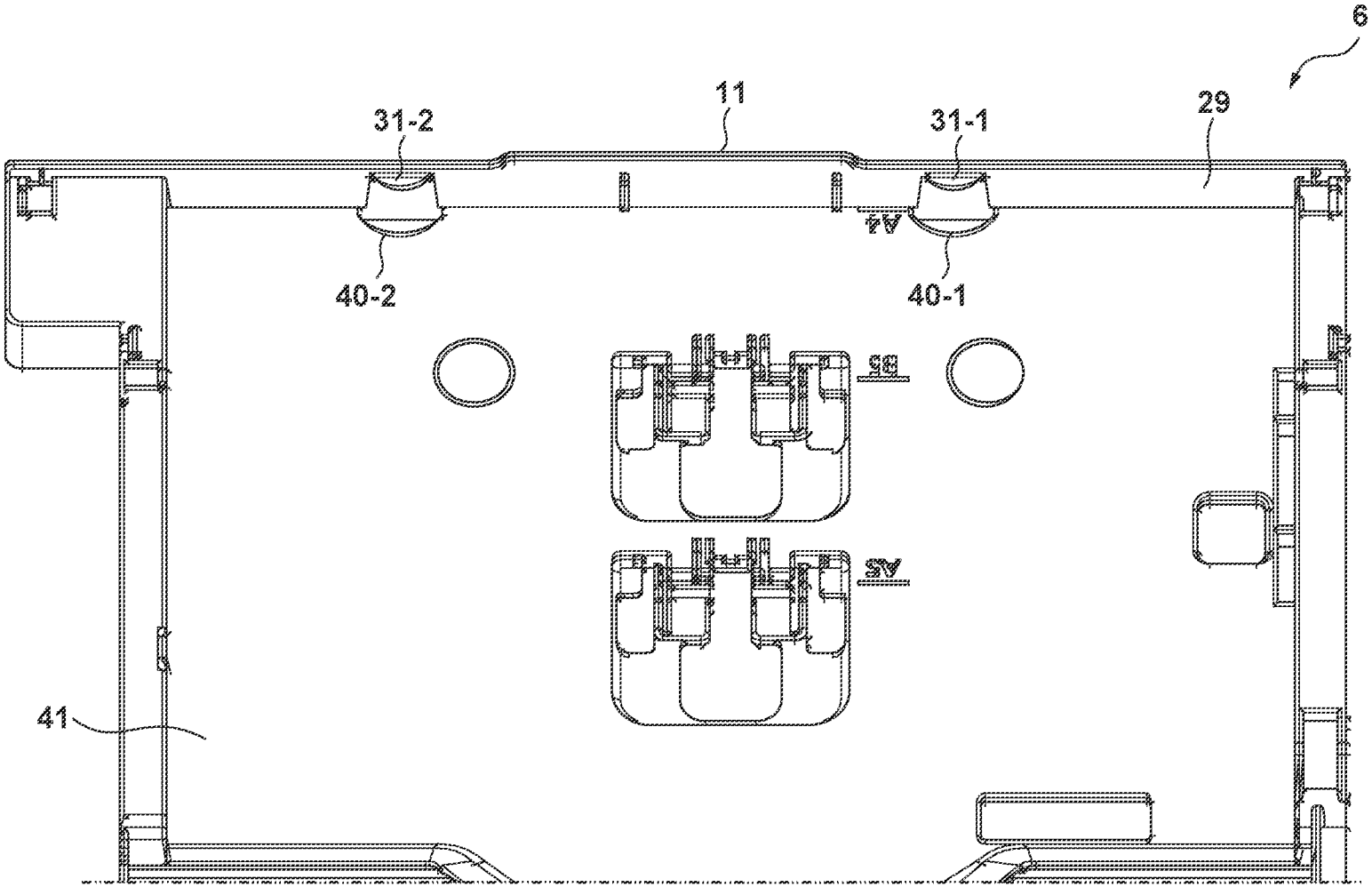

FIGS. 5A and 5B are partial perspective views of the sheet feed cassette 6 on a near side in the insertion direction. There are cases where the sheet feed cassette 6 dominates the size of the image forming apparatus 1, specifically, the size of the sheet feed cassette 6 in the insertion and removal direction. Therefore, in order to reduce the entire size of the image forming apparatus 1, it is effective to reduce the size of the sheet feed cassette 6 in the insertion and removal direction. In order to minimize the size of the sheet feed cassette 6 in the insertion and removal direction, it is necessary to minimize the number of components of the sheet feed cassette 6 on the near side in the insertion direction, as far as possible.

The necessary component is the standing wall 28 on the near side in the insertion direction (back end side in a conveyance direction of sheets) for preventing stacked unprinted sheets from jutting out. The thickness of the standing wall 28 is about 1 to 5 mm. A configuration is appropriate in which an inner face 29 of the standing wall 28 regulates back ends of unprinted sheets in the conveyance direction, and an outer face 30 of the standing wall 28 forms a portion of the exterior of the image forming apparatus 1. Furthermore, two hoods 31 (31-1, 31-2) are provided on the inner face 29 of the standing wall 28 of the sheet feed cassette 6. The height positions of lower faces of the hoods (protrusion) 31 are at a position that is higher than a predetermined position, which is an upper limit of stacking when unprinted sheets are stacked on the stacking face as a sheet bundle, and the positions of the hoods 31 in the transverse direction are positions separated from a center, which is in the vicinity of the gripping portion 11 of the sheet feed cassette 6, by an approximately same distance toward left and right.

Figure 12:
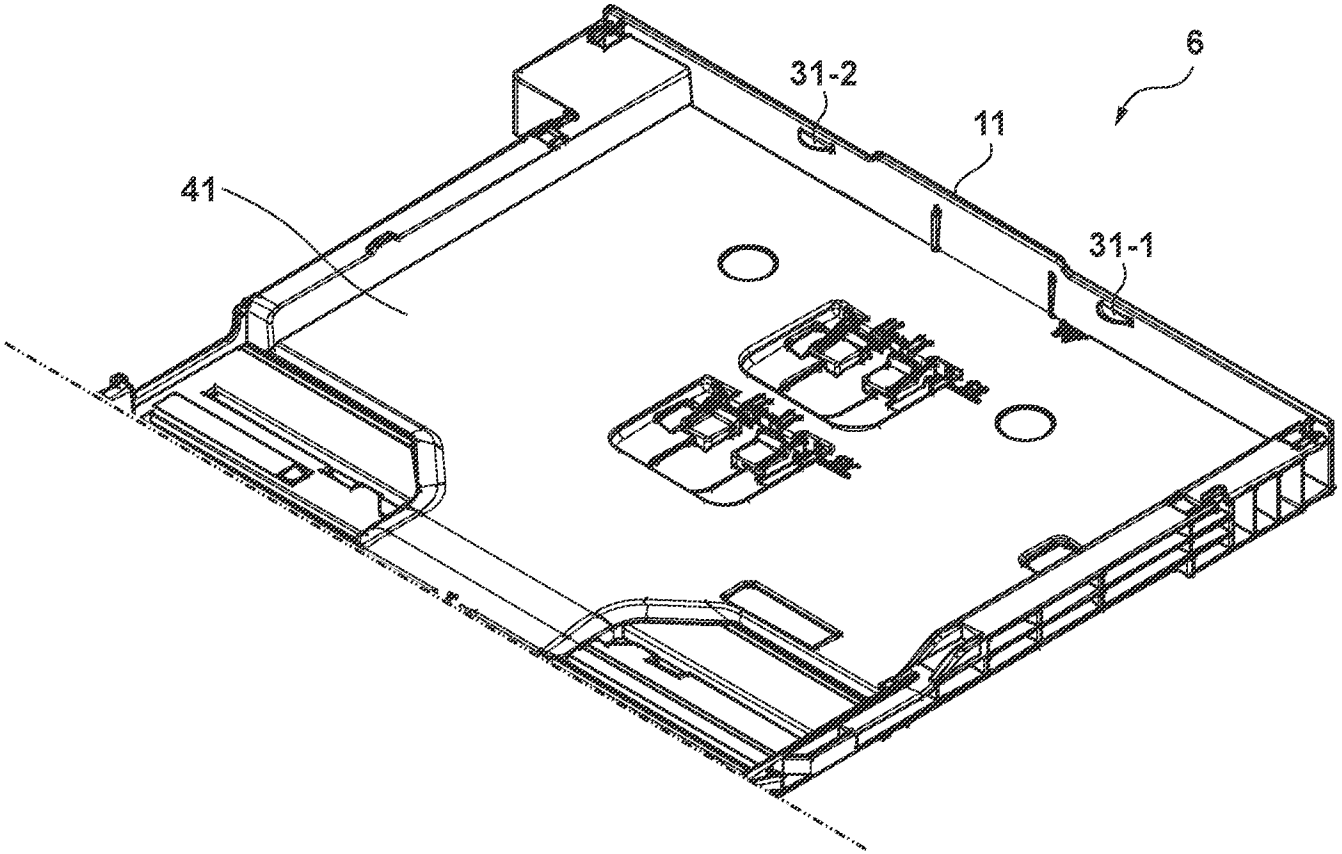
FIG. 12 is a diagram illustrating a modification of the sheet feed cassette.

Holes 40 (40-1, 40-2) are arranged in the placement face 41 on which sheets are placed, at positions opposing the hoods 31. These holes 40 are used to remove a mold when injection molding of the sheet feed cassette 6 is performed. As a result of using such a manufacturing method, the standing wall 28 and hoods 31 can be integrally formed. Note that, even in a case of injection molding, a placement face 41 in which holes are not provided at positions corresponding to the holes 40 can be adopted, as shown in FIG. 12. In the present embodiment, sheets can be placed under the hoods 31. Note that the strength of the hoods can be increased by semicircularly and continuously projecting portions between the hoods and the placement face, for example.

In order to make sheets unlikely be caught when unprinted sheets are set, the shape of each hood 31 viewed from above is formed as a rounded-off shape. The upper face of the hood 31 is in parallel with the upper face of the standing wall 28. Also, side wall upper faces 32 of the sheet feed cassette 6 on the left and right sides are provided with holes 33 into which the back side projections 20 of the cassette cover 7 enter. Similarly, holes 34 to which the near side projections 23 of the cassette cover 7 enter are provided in the sheet feed cassette 6 on the near side in the insertion direction. Furthermore, positioning holes 35 for receiving the positioning projections 26 of the cassette cover 7 are arranged in the left and right side wall upper faces 32 of the sheet feed cassette 6, in order to determine the positional relationship with the cassette cover 7.

Figure 6:
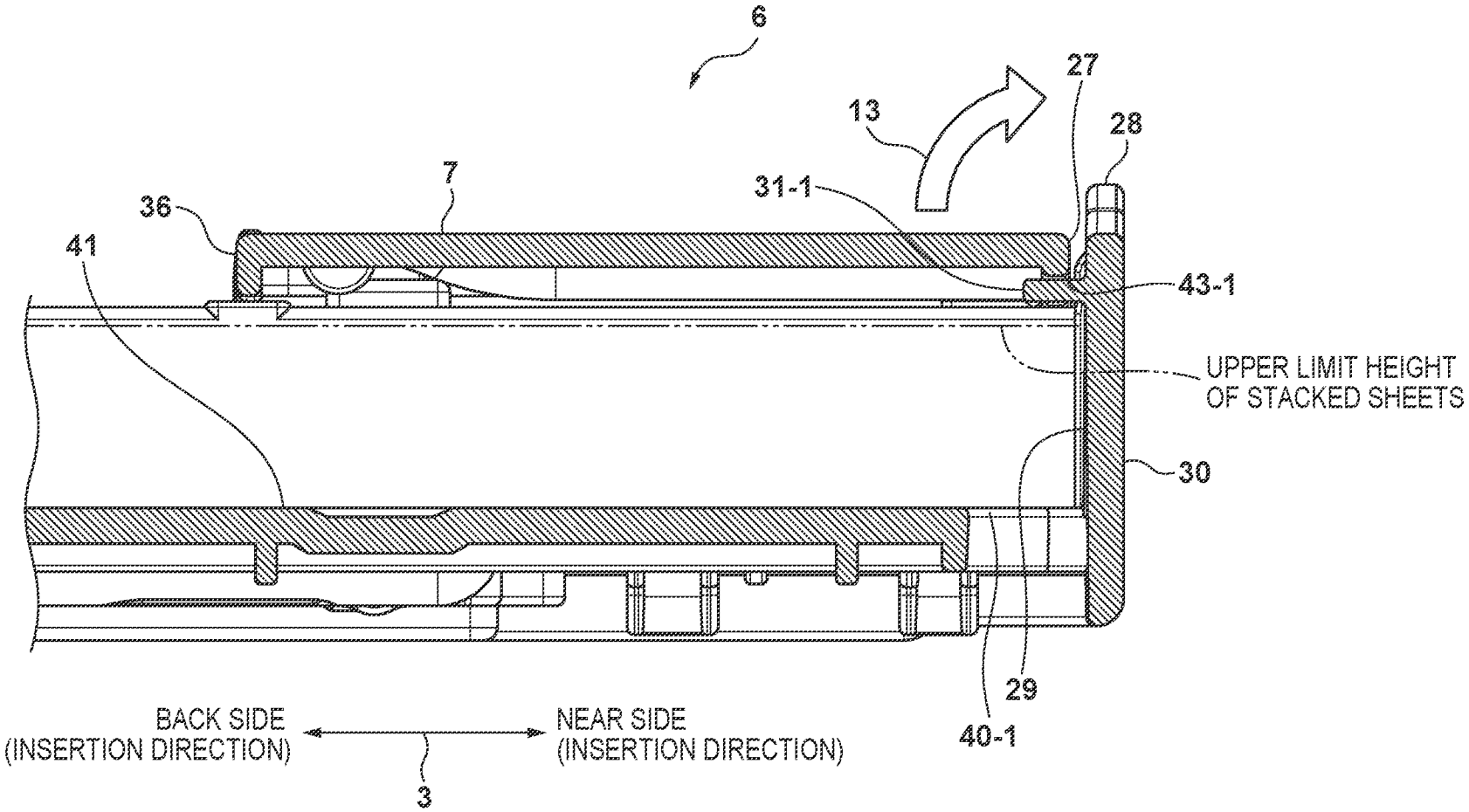
FIG. 6 is an A-A cross-sectional view of FIG. 3.

FIG. 6 is an A-A cross-sectional view of FIG. 3. In a state in which the cassette cover 7 is fitted into a prescribed position, an end portion 27 of the cassette cover 7 on the near side in the insertion direction is arranged at a position adjacent to the inner face 29 of the standing wall 28 of the sheet feed cassette 6 on the near side in the insertion direction. Therefore, the contact parts 43 of the cassette cover 7 for contact with the hoods 31 are positioned immediately above the hoods 31. Here, the cassette cover 7 and the hoods 31 need not be brought into contact, and a gap may be present therebetween.

Figure 7A:
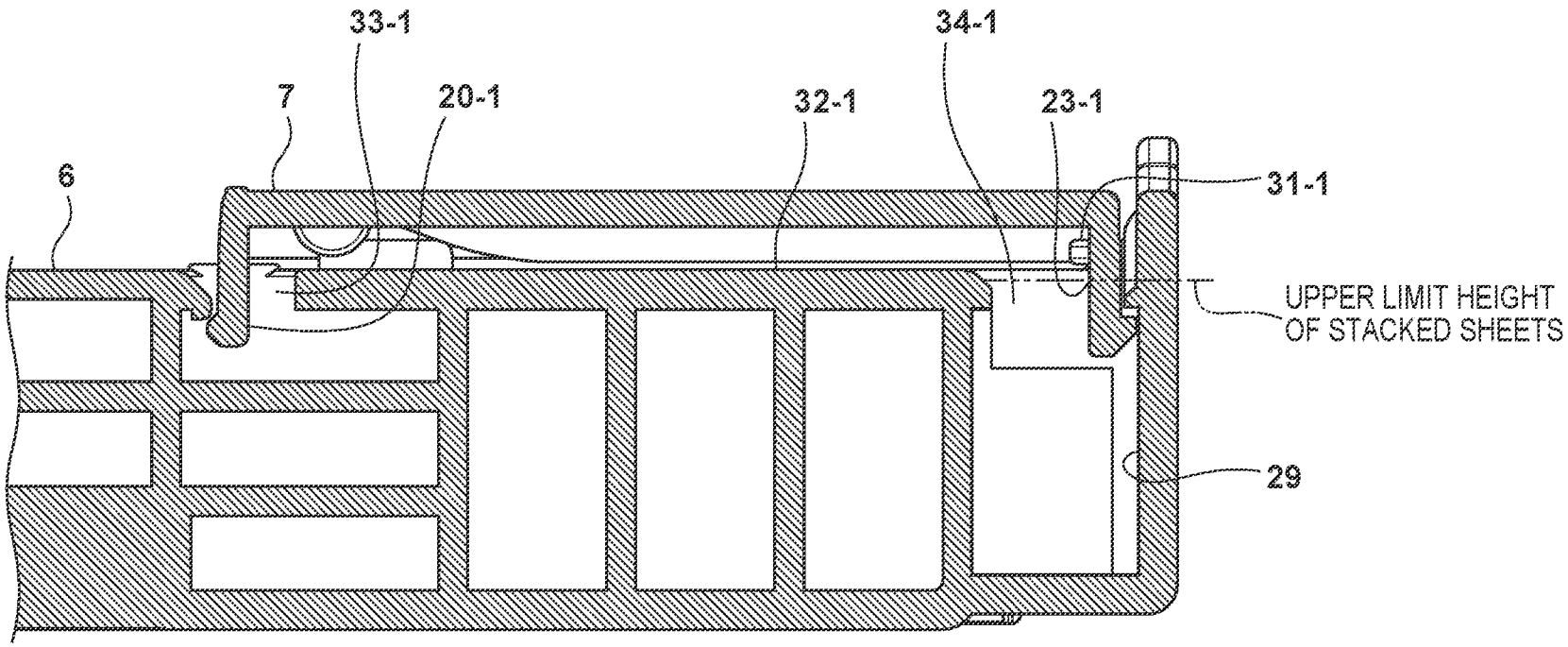
FIGS. 7A to 7C are B-B cross-sectional views of FIG. 3.
Figure 7B:
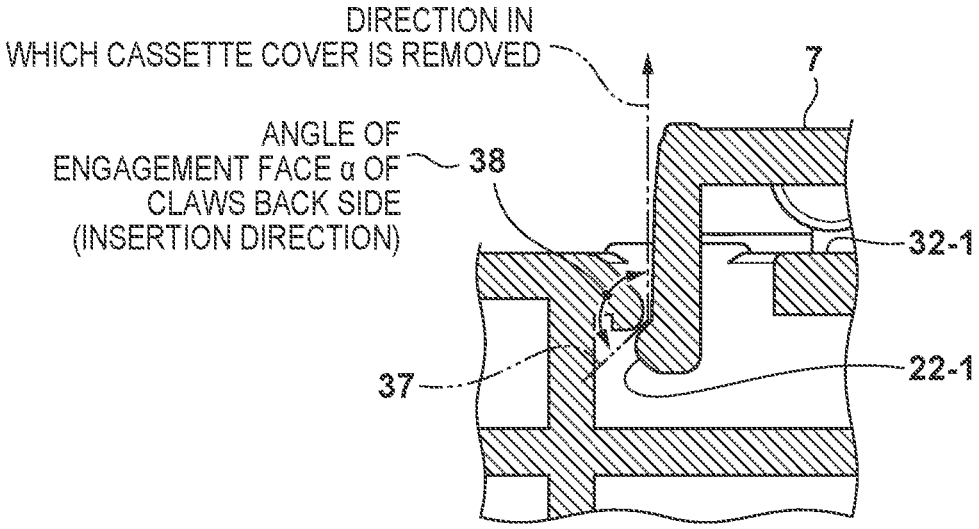
Figure 7C:
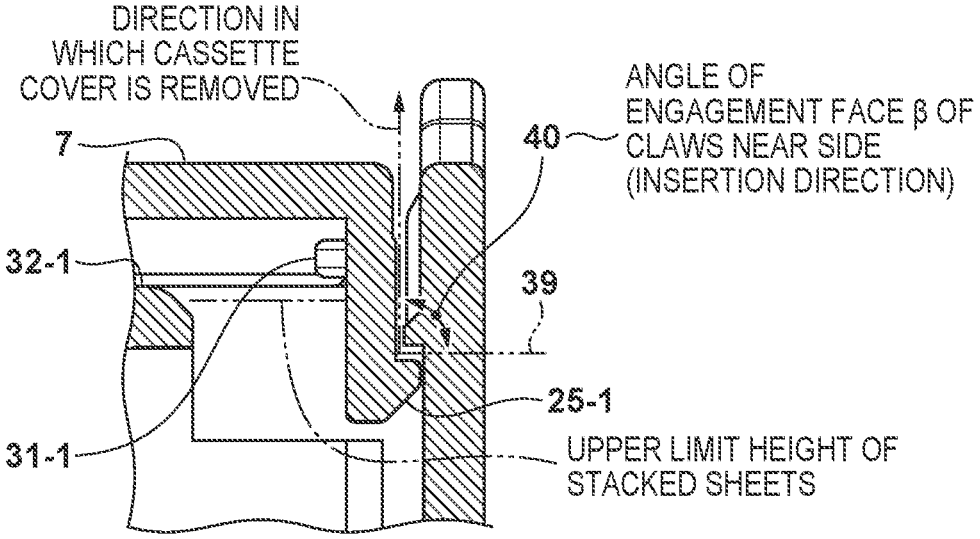

FIGS. 7A to 7C are B-B cross-sectional views of FIG. 3. FIG. 7A is a general drawing of the cross-sectional view, and FIGS. 7B and 7C are respectively enlarged views in the vicinity of the claws on the back side in the insertion direction and on the near side in the insertion direction.

In the state in which the cassette cover 7 is fitted into the prescribed position, the back side claws (claw portions) 22 of the cassette cover 7 are fixed (engaged with) to the sheet feed cassette 6 by engagement faces 37, as shown in FIG. 7B. Here, an angle 38 of the engagement face 37 of the back side claw 22 is set to an angle $\alpha$ relative to the direction of removing the cassette cover 7. The angle $\alpha$ is an angle larger than 90°, in the present embodiment.

On the other hand, the near side claws (claw portions) 25 of the cassette cover 7 are fixed (engaged with) to the sheet feed cassette 6 by engagement faces 39, as shown in FIG. 7C. Here, an angle 40 of the engagement face 39 of the near side claw 25 is set to an angle $\beta$ relative to the direction of removing the cassette cover. The angle $\beta$ is an angle less than or equal to 90°, in the present embodiment.

When unprinted sheets are set to the sheet feed cassette 6, the cassette cover 7 needs to be removed, and when the cassette cover 7 is removed, the cassette cover 7 is lifted upward in a state shown in FIG. 3, or a back side end portion 36 of the cassette cover 7 in FIG. 6 is lifted upward. Then, the cassette cover 7 pivots and opens in a direction of an arrow 13 in FIG. 3, with portions in the vicinity of the hoods 31 and a near side end portion 27 of the cassette cover 7 thereabove being pivot axes.

This pivot motion is realized as a result of the back side claws 22 easily coming off by an upward force, because the angle $\alpha$ of the engagement faces 37 of the back side claws 22 is larger than the angle $\beta$ of the engagement faces 39 of the near side claws 25.

After the cassette cover 7 is opened, unprinted sheets are set to the sheet feed cassette 6, and the cassette cover 7 is attached to the sheet feed cassette 6 from above. When the cassette cover 7 is attached, attachment can be performed from one of the back side claw 22 side and the near side claw 25 side, or attachment can be performed on the both sides at the same time. Then, the positioning projections 26 of the cassette cover 7 are inserted into the respective positioning holes 35 of the sheet feed cassette 6, and as a result, the positional relationship between the sheet feed cassette 6 and the cassette cover 7 is correctly regulated. Note that, in the present embodiment, the positioning projections 26 are each located between the back side projection 20 and the near side projection 23, but the position is not limited thereto.

When the sheet feed cassette 6 replenished with sheets is attached to the image forming apparatus 1, a user grips the gripping portion 11 of the sheet feed cassette 6, and inserts the sheet feed cassette 6 into the image forming apparatus 1 through the later-described opening portion 8.

Figure 8:
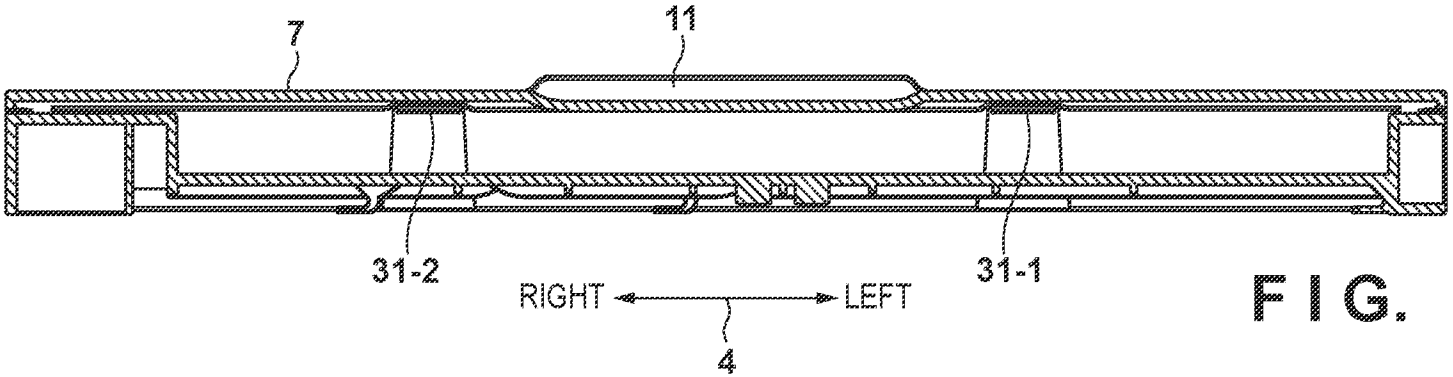
FIG. 8 is a C-C cross-sectional view of FIG. 3.

FIG. 8 is a C-C cross-sectional view of FIG. 3. When the user grips the gripping portion 11 of the sheet feed cassette 6, his/her hand also grips the standing wall 28 of the sheet feed cassette 6 and the cassette cover 7, and the cassette cover 7 deforms at this time. This is because there is no hood 31, for suppressing deformation of the cassette cover 7, immediately below the gripping portion 11 of the sheet feed cassette 6, and a portion in the vicinity of the gripping portion 11 of the cassette cover 7 deforms downward, with contact points with the hoods 31 on the left and right sides being points of support. If there are no hoods 31 at all, the cassette cover 7 deforms more than necessary, and it will not feel rigid to the user. As a result of the presence of hoods 31, the user can have rigidity feeling when gripping the gripping portion 11 of the sheet feed cassette 6. Also, if the size of the gripping portion 11 is sufficiently large for being gripped, as a result of reducing the horizontal distance between the two hoods 31, a gripping portion that only deforms a small amount and feels rigid to the user can be obtained. That is, as a result of appropriately setting the number of hoods and the arrangement thereof, the feeling of rigidity of the sheet feed cassette 6 and cassette cover 7 when the sheet feed cassette 6 is attached and detached can be appropriately controlled.

Furthermore, the positional relationship between the parts of the sheet feed cassette 6 and the cassette cover 7 in the present embodiment will be described. Regarding the height direction, as shown FIGS. 7A to 7C, the engagement faces 37 and 39 of the claws are at positions lower than the upper limit height of sheets that are stacked, and the lower faces of the hoods 31 are at positions higher than the upper limit height of sheets that are stacked, as described above. The heights of the side wall upper faces 32 of the sheet feed cassette 6 are at positions the same as or higher than the upper limit height of sheets that are stacked, and are positioned below the lower faces of the hoods 31. Also, the contact parts 43 of the cassette cover 7 for contact with the hoods 31 are arranged immediately above the hoods 31 with a small gap therebetween. The upper end of the standing wall 28 of the sheet feed cassette 6 on the near side in the insertion direction is located at a position higher than the cassette cover 7, with which a space of the gripping portion 11 for the user's finger being caught is formed.

Regarding the insertion direction of the sheet feed cassette 6, the hoods 31 that protrude from the inner face 29 of the standing wall 28 in the near side in the insertion direction protrude toward the back side in the insertion direction beyond the contact faces of the contact parts 43 of the cassette cover 7. This is because, when the user strongly grips the cassette cover 7 and the sheet feed cassette 6, the contact parts 43 of the cassette cover 7 are prevented from riding over the hoods 31 of the sheet feed cassette 6 and largely moving downward.

Also, in the present embodiment, the projections 20 and 23 each having a claw and the positioning projections 26 that are arranged in the cassette cover 7 are not arranged horizontally symmetrically. This is because, due to the structure of the image forming apparatus 1, although unprinted sheets cannot be arranged at the center of the sheet feed cassette 6 in the horizontal direction, the gripping portion 11 of the sheet feed cassette 6 is arranged at the center of the sheet feed cassette 6 in the horizontal direction, from a design viewpoint.

When the user grips the gripping portion 11, the cassette cover 7 deforms with the two hoods 31 being points of support, and the cassette cover 7 deforms downward at positions closer to the gripping portion 11 relative to the hoods 31, in the horizontal direction, but the cassette cover 7 deforms so as to be lifted upward at positions farther from the gripping portion 11 relative to the hoods 31. The force of deformation of being lifted upward is larger on the near side in the insertion direction of the sheet feed cassette 6 than on the back side, because of the closeness to the gripping portion 11 and the hoods 31. In contrast, the engagement faces 37 and 39 of the claws resist the force of the cassette cover 7 lifting upward, and as a result, the cassette cover 7 is suppressed from coming off. In the present embodiment, the unbalance in force is resolved by arranging the projections 23 each having a claw on the near side in the insertion direction of the sheet feed cassette 6 substantially symmetrically in the horizontal direction.

Note that, in the present embodiment, the objective is achieved with the configuration described above, but the present invention is not limited to the configuration described above. For example, the side wall upper faces 32 may have heights so as to be positioned above the lower faces of the hoods 31, and in this case as well, the cassette cover 7 moves with portions in the vicinity of the near side end portion 27 of the cassette cover 7 that are located above the hoods 31 serving as the pivot axes. In addition thereto, a horizontally symmetrical configuration may also be adopted.

Figure 9:
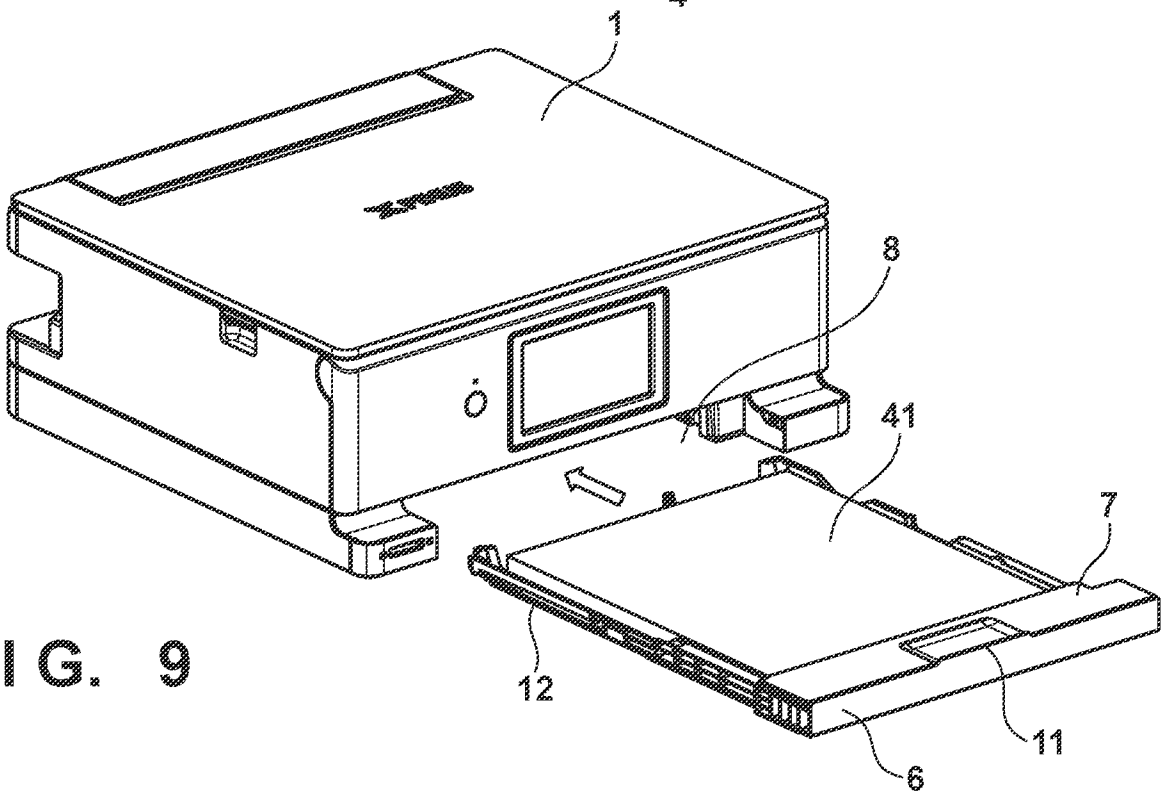
FIG. 9 is a perspective view illustrating the manner of inserting the sheet feed cassette to the image forming apparatus.
Figure 10:
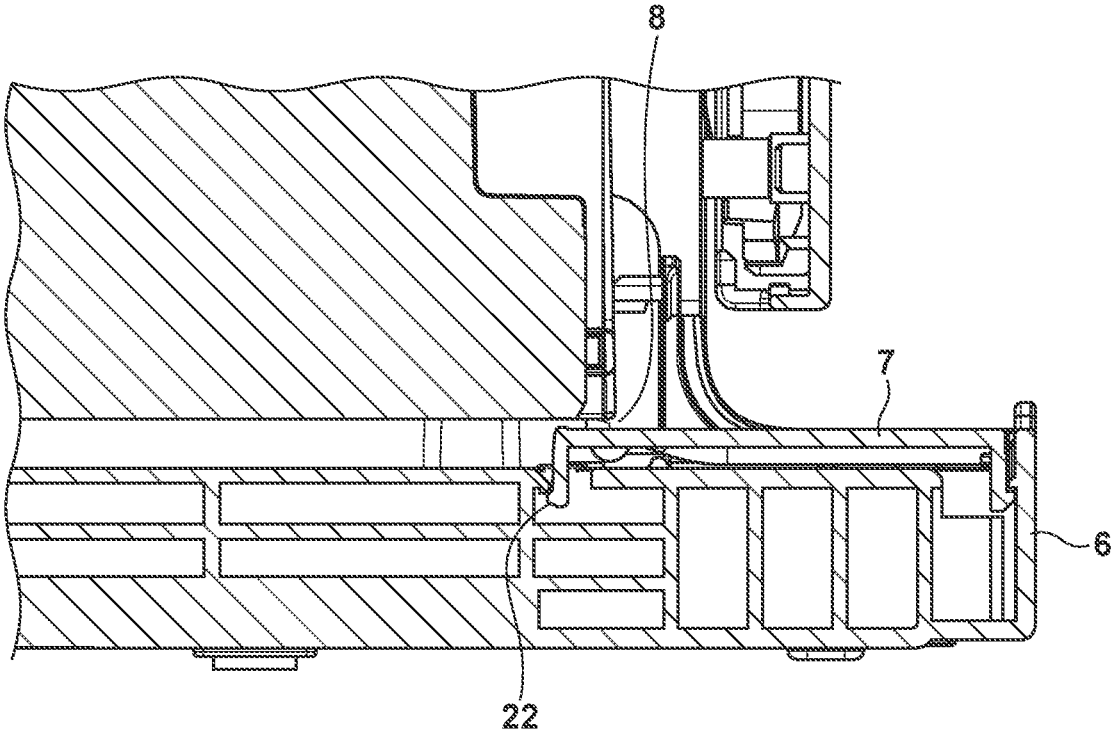
FIG. 10 is a cross-sectional view in a state in which the sheet feed cassette is inserted into the image forming apparatus in the first embodiment.

FIG. 9 is a perspective view illustrating the manner of inserting the sheet feed cassette 6 to the image forming apparatus 1. FIG. 10 is a cross-sectional view of the opening portion 8 for receiving the sheet feed cassette 6 and a portion in the vicinity of a claw engagement face of the cassette cover 7, in a state in which the sheet feed cassette 6 is attached to the image forming apparatus 1.

As a result of the user gripping the sheet feed cassette 6 and the cassette cover 7 and inserting them into the opening portion 8 of the image forming apparatus 1, the rails 12 of the sheet feed cassette 6 align with rails (not shown) inside the image forming apparatus 1, the position in the vertical and horizontal directions is determined, and the sheet feed cassette 6 is attached. At an insertion end, the entering position of the sheet feed cassette 6 is regulated by an unshown stopper, and the position of the sheet feed cassette 6 inside the image forming apparatus 1 in the insertion direction is determined.

Here, as shown in FIG. 10, the back side claws 22 have entered inside the image forming apparatus 1 relative to the opening portion 8. The back side claws 22, which are easily coming off, are caused to enter inside the image forming apparatus 1, and therefore, the back side claws 22 are suppressed from coming off. On the other hand, the near side claws 25 of the cassette cover 7 are originally structured so as not to easily come off from the sheet feed cassette 6, and therefore, although they are exposed from the image forming apparatus 1, no problem arises. According to such a structure, when the image forming apparatus 1 is packaged in a state of the sheet feed cassette 6 being attached thereto, falling out of the cassette cover 7 can be prevented without performing processing for suppressing falling out on the cassette cover 7 by a package material, a tape, or the like.

As described above, according to the present embodiment, the rigidness of the gripping portion of the sheet feed cassette including the cassette cover can be secured while keeping the size of the sheet feed cassette in the insertion and removal direction small. Also, an image forming apparatus can be provided in which the cassette cover is unlikely to come off due to impact at the time of packaging.

Second Embodiment

In the first embodiment, an example in which hoods are provided at two locations has been described. In a second embodiment, a hood is provided at one location will be described. The other configurations are the same as those of the first embodiment described above, and therefore the description thereof will be omitted.

The height position of the hood is similar to the first embodiment, but the position in the transverse direction is set to a position immediately below the gripping portion 11 (recess 7*a*), for example. The length of the hood in the transverse direction may be the same as the range determined as the gripping portion, or may also extend over the entire width range.

According to such a configuration, the deformation of the cassette cover 7 when a user grips the gripping portion 11 of the sheet feed cassette 6 can be suppressed, and the rigidness can be secured.

Third Embodiment

In the first embodiment, an example has been described in which the orientation of the installation faces 21 of the back side claws 22 of the cassette cover 7 is the same as the insertion direction of the sheet feed cassette 6. In the third embodiment, an example will be described in which the installation faces of back side claws 22 of the cassette cover 7 face the inside of the sheet feed cassette. The other configurations are the same as those of the first embodiment described above, and therefore the description thereof will be omitted.

Figure 11A:
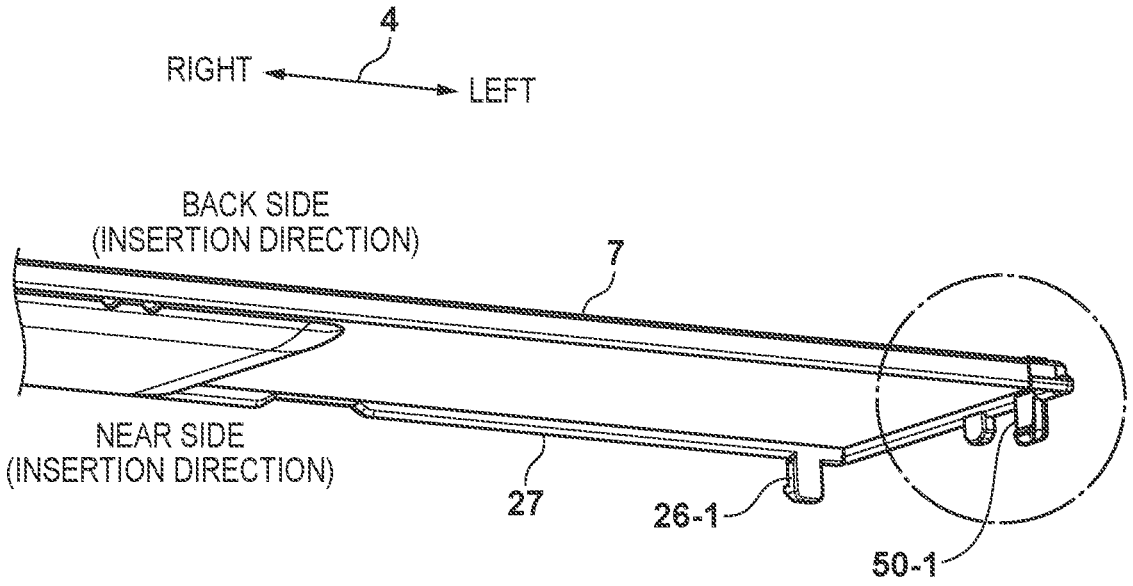
FIGS. 11A and 11B are perspective views of a cassette cover in a third embodiment.
Figure 11B:
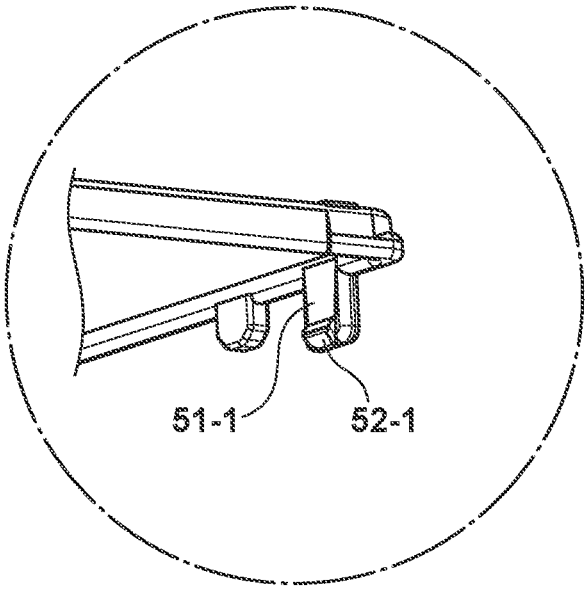

In the present embodiment, as shown in FIGS. 11A and 11B, installation faces 51 of back side claws of back side projections 50 provided in the cassette cover 7 face an inward direction of the sheet feed cassette 6, and the back side claws 52 are provided on the installation faces 51.

In accordance therewith, side wall portions of the sheet feed cassette 6 are provided with holes into which the respective back side projections 50 enter, and engagement faces (not shown) that engage with the back side claws 52. Note that the angle relationship between the engagement faces on the back side and the near side is similar to that of the first embodiment described in FIGS. 7A to 7C.

In such a configuration as well, as a result of lifting the cassette cover 7 upward, the portions in the vicinity of the near side end portion 27 and the hoods 31 function as pivot axes for the cassette cover 7, and as a result, the cassette cover 7 can be easily removed.

Note that, in the embodiments described above, an ink-jet type multi-function peripheral has been illustrated as the image forming apparatus, but the present invention is not limited thereto, and the image forming apparatus may also be a facsimile or another image forming apparatus such as a laser beam printer. The similar effects can be obtained when the present invention is applied to the sheet feed cassettes used is these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2021-134275, filed Aug. 19, 2021, and No. 2022-090385, filed Jun. 2, 2022, which are hereby incorporated by reference herein in their entirety.

What is claimed is:

1. A cassette comprising:

a housing portion configured to have a placement face on which sheets are placed and to house sheets;

a standing wall configured to constitute a portion of the housing portion, and to regulate sheets on a back end side in a conveyance direction of sheets to be conveyed from the placement face to a printing apparatus;

a protrusion provided on the standing wall and configured to protrude toward the placement face at a position above a predetermined position, which is at a height of sheets that can be stacked on the placement face, wherein the protrusion is located at a position below a standing wall upper portion, which is an upper portion of the standing wall that can be gripped;

a cassette cover, including a contact portion that can be in contact with the protrusion from above, configured to be attached to the housing portion and to prevent housed sheets from being exposed, and a recess configured to be formed in the cassette cover and to function as a gripping portion of the cassette along with the standing wall upper portion, wherein an outer face of the standing wall constitutes a portion of an exterior of the printing apparatus, in a state in which the cassette is attached to the printing apparatus;

wherein an end portion of the cassette cover on a standing wall side is arranged at a position closer to an inner face of the standing wall than the outer face, with the inner face being opposite to the outer face, and wherein the back end side of the sheets is placed under the protrusion.

2. The cassette according to claim 1, wherein the placement face is provided with a hole at a position opposing the protrusion.

3. The cassette according to claim 1, wherein the standing wall includes a plurality of protrusions.

4. The cassette according to claim 3, wherein the plurality of protrusions are arranged on both sides relative to the standing wall upper portion.

5. The cassette according to claim 3, wherein the recess is arranged between a plurality of contact portions of the cassette cover.

6. The cassette according to claim 1, wherein the contact portion of the cassette cover is formed immediately below the recess.

7. The cassette according to claim 1, wherein the cassette cover includes a first claw portion to be engaged with the housing portion at a first position, which is on a back side in an insertion direction of the cassette into the printing apparatus, and a second claw portion to be engaged with the housing portion at a second position, which is on a near side in the insertion direction, and the first claw portion is configured such that the engagement is easily released relative to the engagement of the second claw portion.

8. The cassette according to claim 7, wherein the first position is located on a back side of the printing apparatus relative to an opening portion through which the cassette of the printing apparatus is inserted.

9. The cassette according to claim 7, wherein the angle of a portion, of the first claw portion, that engages with the housing portion is larger than 90°.

10. The cassette according to claim 7, wherein the angle of a portion, of the second claw portion, that engages with the housing portion is 90° or less.

11. A printing apparatus to which the cassette according to claim 1 is attachable.

12. The printing apparatus according to claim 11, wherein a console panel is arranged on a front face side of the apparatus, and the console panel, when the cassette is attached, is located on the placement face side relative to the standing wall.

13. The cassette according to claim 1, wherein an upper surface of the cassette cover, which is attached to the housing portion, is positioned lower than the standing wall upper portion.

* * * * *